United States Patent [19]

Kieber

[11] 4,326,648

[45] Apr. 27, 1982

[54] HOLDING DEVICE FOR HOLDING A DISPENSER CONTAINER

[75] Inventor: Lothar Kieber, Mülheim, Fed. Rep. of Germany

[73] Assignee: Deutsche Calypsolgesellschaft mbH & Co., Düsseldorf, Fed. Rep. of Germany

[21] Appl. No.: 121,610

[22] Filed: Feb. 14, 1980

[30] Foreign Application Priority Data

Feb. 21, 1979 [DE] Fed. Rep. of Germany ... 7904778[U]

[51] Int. Cl.[3] ..... B67D 5/64

[52] U.S. Cl. ..... 222/162; 222/181; 248/311.3

[58] Field of Search ..... 222/162, 181, 183, 185, 222/402.1, 402.14; 248/311.3; 239/282, 283, 573; 128/213 R, 214 F, 218 NV, DIG. 12

[56] References Cited

U.S. PATENT DOCUMENTS

| | | | |
|---|---|---|---|
| 2,200,024 | 5/1940 | Sipio et al. | 222/162 |
| 2,601,061 | 6/1952 | Schwartz | 222/162 |
| 2,700,578 | 1/1955 | Efford | 222/183 X |
| 2,768,659 | 10/1956 | Kirkendall | 222/181 X |
| 2,935,232 | 5/1960 | Thomas | 222/162 |
| 2,988,822 | 9/1961 | Birch et al. | 222/162 X |
| 3,306,189 | 2/1967 | Alcamo | 222/162 X |
| 3,342,544 | 9/1967 | Curiel | 222/185 X |
| 3,589,338 | 6/1971 | Lovitz | 248/311.3 X |
| 3,718,234 | 2/1973 | Bagguley | 222/181 X |

*Primary Examiner*—Robert J. Spar
*Assistant Examiner*—Fred A. Silverberg
*Attorney, Agent, or Firm*—Martin A. Farber

[57] ABSTRACT

A holding device for holding a two-chamber pressurized dispensing container in an inverted position with its dispensing valve directed downwardly, comprises a lower supporting arm having an opening through which the valve extends. The container is held above the supporting arm by one or more supporting rings which surround the container body, but which permit downwards movement of the container body. The container is supported from the arm by its valve so that the valve will be opened on application of downwards pressure to the container body.

5 Claims, 1 Drawing Figure

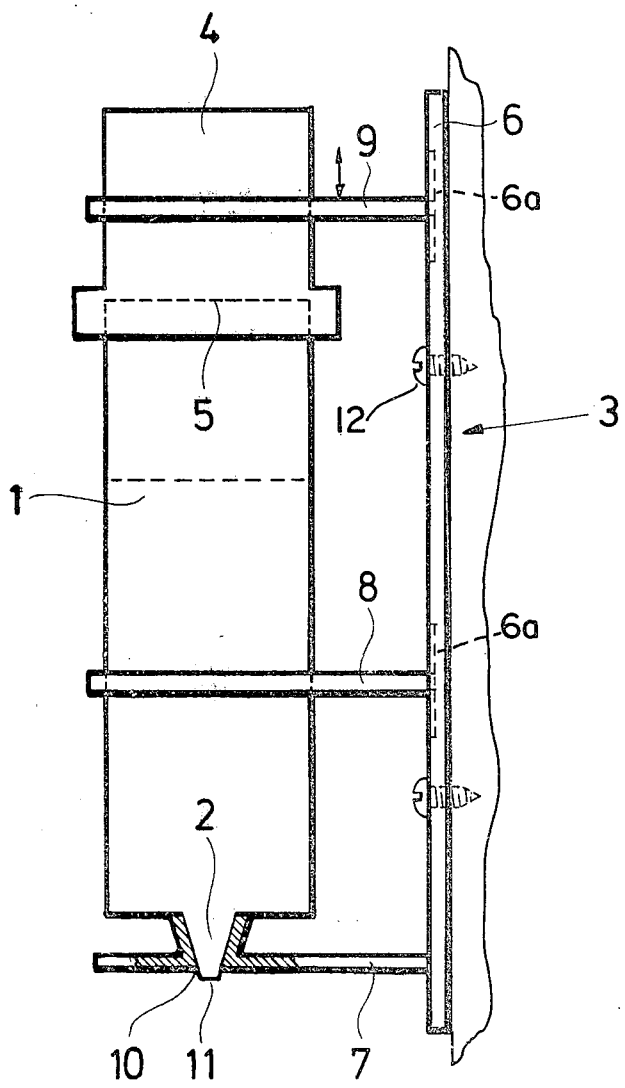
4
9
6
6a
5
12
3
1
8
6a
2
10
11
7

HOLDING DEVICE FOR HOLDING A DISPENSER CONTAINER

BACKGROUND OF THE INVENTION

1. Field of the Invention

The present invention relates to a device for holding a two-chamber dispensing container in a position for use with its dispensing valve directed downwardly.

2. Description of the Prior Art

Conventional pressurized spray containers, in which the propellant and substance to be dispensed are contained in a common chamber, cannot be used in an inverted position with the dispensing valve at the bottom, because in this position only the propellant would be discharged from the container.

Two-chamber spray containers, with the propellant separated from the substance to be dispensed, permit satisfactory dispensing of the substance to take place with the container inverted. In two-chamber pressurized spray containers, an elastic chamber is filled with compressed air, and this is used to dispense the contents of the second chamber under pressure through a valve.

A requirement exists for a device for holding such a two-chamber spray container or other two-chamber dispensing container in a position of use with the valve directed downwardly.

SUMMARY OF THE INVENTION

According to the invention, there is provided a device for use with a two-chamber dispensing container having a dispensing valve with an outlet, for holding the container in an operative position with the valve directed downwardly, said holding device comprising support means, ring means for holding the container in a vertical position on the support means, while permitting axial movement of the container, said ring means surrounding the container and being disposed at a distance from the support means, and means defining an opening in the support means for securely holding the valve in position upon downwards axial displacement of the container, with the dispensing valve passing through the opening so that the outlet of the valve is disposed under the support means.

Further according to the invention, there is provided in combination, a two-chamber pressurized dispensing container having a dispensing valve with an outlet, and a device holding said container in an inverted position with its valve directed downwardly, said holding device comprising support means, means defining an opening in the support means, said container being supported on said support means by means of its dispensing valve with the valve extending through the opening so that the outlet lies beneath the support means, and means located above the support means for retaining the container while permitting downwards movement of the container to open the valve.

Preferably, the support means is in the form of a flat supporting arm which is fixed on a sheet metal support which extends parallel with the container. The sheet metal support preferably carries, at a distance from and parallel with the first ring means, a further ring which holds the cover of the container in a position supported on the bottom of the container. By this means it is possible to insert a two-chamber pressurized dispensing container inverted into the two rings and subsequently to slip the container cover on the bottom of the container in such a manner that it protrudes through the upper ring of the holder. In this manner the container is not readily removable by persons who do not know the exact manner by which the container is held, whereas the container can simply be removed and replaced by authorized personnel who know how the container is held. Preferably, the holder ring (or rings) is positionable adjustably in a vertical direction so as to permit an adaptation to the various lengths of containers available. The device may be constructed as a wall holder, for which purpose there may be provided fixing holes in the sheet metal support, the latter extending parallel with the container.

BRIEF DESCRIPTION OF THE DRAWINGS

An embodiment of the invention, will now be described by way of example only, with reference to the accompanying diagrammatic drawing, the sole FIGURE of which is an elevation of a holding device and a two-chamber dispensing container in situ in the device.

DESCRIPTION OF THE PREFERRED EMBODIMENT

As shown in the drawing, a two-chamber pressurized dispensing container 1 is disposed in a dispensing position in a holding device 3, the container 1 being vertical with its dispensing valve 2 being directed downwardly. In the dispensing position the cover 4 of the container is supported on the bottom 5 of the container, the bottom being represented by a dashed line. In this particular embodiment, the product to be dispensed from the container is a soap gel.

The holding device 3 consists of a sheet metal support 6 parallel with the container 1, to which there are fixed at a distance from one another, a lower flat supporting arm 7 acting as a platform support, a first, intermediate, holding ring 8 and a second, upper, holding ring 9. In the sheet metal support 6, holes (not shown) are provided for fixing the holding device to the wall of a bathroom by means of screws 12.

An opening 10 is provided in the supporting arm 7 to hold the valve 2 securely in its position. For this purpose the opening 10 may have sharp edges, so that it cuts into the plastics material of the valve 2 on a rotary movement of the container 1 under slight downwards pressure. Alternatively, the valve may be provided with a step, a notch or a gradation which rests on the edge of the opening and holds the valve in place on a downward movement of the container. In this connection it is important that the valve outlet 11 should extend below the opening 10 to such an extent that it is possible to draw the soap gel freely downwards or to the side under the supporting arm 7.

The first holding ring 8 is situated at a distance from the supporting arm 7 such that it surrounds in a slide hold the body of the container 1 and holds the container while permitting the container to be moved axially relative to the ring 8. The container 1, when the cover 4 has been removed, must be able to be pushed from above through the opening of the first holding ring 8, and to be relatively tightly or closely surrounded by the ring 8 when the valve 2 lies on the supporting arm 7.

The second holding ring 9 is fixed on the sheet metal support 6 at a distance from, and parallel to, the holding ring 8. In this arrangement the distance selected between the holding rings 8 and 9 is such that the cover 4 of the container 1 can be inserted into the opening of the holding ring 9 from below before insertion of the container 1, and be held in an upper position until the container 1 itself has been pushed through the first holding ring 8; then the cover 4 is moved downwardly onto the bottom 5 of the container as illustrated. A simple removal of the container from the holding device is then no longer possible.

To simplify adaptation to various container sizes, or also to simplify the insertion of the containers, the holding rings 8 and/or 9 can be fixed to the support 6 in a vertically displaceable manner for example in corresponding longitudinal holes 6*a* in the sheet metal support 6.

In use, the user exerts a downwardly-directed pressure onto the cover 4 of the container. The container then moves downwardly in the holding device, the valve 2 being held firmly in the supporting arm 7. Soap gel can then flow out downwardly through the valve outlet 11.

Although in the example described the container contains a gel to be dispensed, the container may alternatively be in the form of a two-chamber spray container.

Thus in the holding device described the special valve of the two-chamber pressurized container protrudes downwardly out of the opening of the support, the valve being held securely so that a downward pressure applied to the container will actuate the container.

What is claimed is:

1. A device and container combination for removably holding a two-chamber dispensing container, having a dispensing valve with an outlet and a cap constituting a container cover having a peripheral flange adjacent an entrance of an opening in the cover, the latter being removably disposed selectively covering the valve and pluggable on a bottom of the container, respectively, in an operative position with the valve directed downwardly, comprising support means comprising a flat supporting arm formed with an opening means for securely holding the valve therein directed downwardly with the dispensing valve projecting through the opening such that the outlet of the valve is disposed under the support means, first ring means for holding the container in a vertical position on said support means while permitting axial movement of the container, said ring means for surrounding the container and being disposed at a distance above the support means, a sheet metal support extending parallel to the container and rigidly connected to said support means, the latter extending perpendicularly from said sheet metal support, a second ring means disposed above, spaced from and parallel to said first ring means and said bottom of said container when the latter is held inverted in said first ring means and in said opening means and then for holding said container cover projecting upwardly through said second ring means in a lower position of said cover relative to said second ring means plugged on the container bottom and selectively for holding said cover in an upper position thereof relative to said second ring means spaced from said bottom of said container, said second ring means and said cover being spaced above the bottom of said container and above said first ring means in said upper position of said cover by a distance, such that the container only then can be removed from said first ring means and said opening means and such that said cover can only be inserted into said second ring means from below with said flange facing down prior to insertion of said container in said first ring means and in said opening means and such that said cover can be held in said upper position in said second ring means until said container has been inserted through said first ring means and into said opening means, said first and said second ring means being connected to said sheet metal support extending perpendicularly therefrom.

2. The device according to claim 1, where at least one of said ring means is adjustable in position in a vertical direction lengthwise of said sheet metal support.

3. The device according to claim 1, wherein said support is formed with a longitudinal hole in which said at least one ring means is vertically adjustably mounted.

4. The device according to claim 1, wherein said support is adapted to be mounted on a wall.

5. The device according to claim 1, wherein said opening means forms a frustoconical portion projecting upwardly from said support means and formed with a frustoconical opening continuing through a bottom of said support means in which said dispensing valve engages, said first ring means is formed with an opening means larger than but substantially complementary to the periphery of said container for snuggly holding said container but permitting axial movement of the container relative thereto, said second ring means is formed with an opening means substantially complementary to the periphery of said container cover for holding said cover, yet permitting axial movement relative thereto, but smaller than the periphery of said flange, whereby only when said cover is lifted in said second ring means off from said bottom of said container, is said container removable from said first ring means.

* * * * *

UNITED STATES PATENT AND TRADEMARK OFFICE

CERTIFICATE OF CORRECTION

PATENT NO. : 4,326,648

DATED : April 27, 1982

INVENTOR(S) : Lothar Kieber

It is certified that error appears in the above—identified patent and that said Letters Patent is hereby corrected as shown below:

The Figure of drawing should read as per attached.

Signed and Sealed this

*Eighteenth* Day of *January 1983*

[SEAL]

*Attest:*

GERALD J. MOSSINGHOFF

*Attesting Officer*

*Commissioner of Patents and Trademarks*

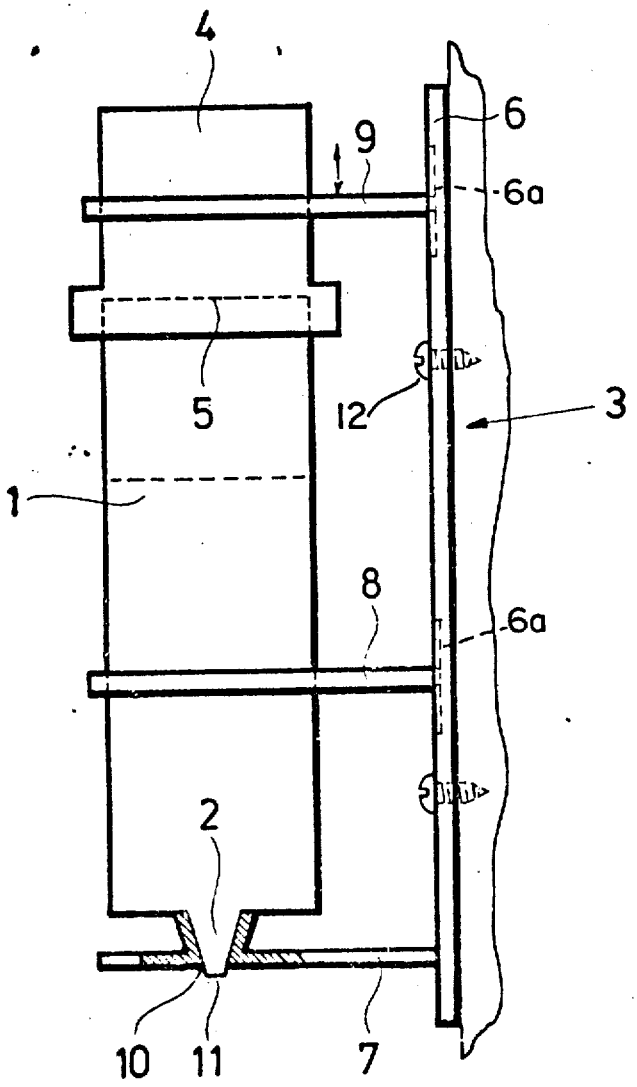
4
9
6
6a
5
12
3
1
8
6a
2
10
11
7